US011326797B2

(12) United States Patent
Shaffer

(10) Patent No.: US 11,326,797 B2
(45) Date of Patent: May 10, 2022

(54) GAS SENSING SYSTEM FOR AN AIR CONDITIONER UNIT

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 86 days.

(21) Appl. No.: 16/847,802

(22) Filed: Apr. 14, 2020

(65) Prior Publication Data

US 2021/0318011 A1 Oct. 14, 2021

(51) Int. Cl.

| | |
|---|---|
| ***F24F 11/36*** | (2018.01) |
| ***F24F 1/035*** | (2019.01) |
| ***F24F 1/027*** | (2019.01) |
| ***F24F 11/89*** | (2018.01) |

(52) U.S. Cl.

CPC ..... *F24F 11/36* (2018.01); *F24F 1/027* (2013.01); *F24F 1/035* (2019.02); *F24F 11/89* (2018.01)

(58) Field of Classification Search

CPC ..... F25B 2500/222; F24F 1/031; F24F 1/022; F24F 1/02; F24F 1/027; F24F 1/035; F24F 11/89; F24F 11/36

See application file for complete search history.

(56) References Cited

U.S. PATENT DOCUMENTS 5,371,467 A * 12/1994 Jeffers ..... G01M 3/16 324/455
7,449,694 B2 11/2008 Yi et al.
2002/0070869 A1* 6/2002 Dungan ..... G08B 21/16 340/632
2017/0336092 A1* 11/2017 Ikawa ..... F25B 1/00
2019/0170598 A1 6/2019 McQuade et al.

FOREIGN PATENT DOCUMENTS

JP H07159010 A * 6/1995
JP 2004003864 A 1/2004

OTHER PUBLICATIONS

JPH07159010A Translation (Year: 1995).*
Understanding MERV, NAFA User's Guide for ANSI/ASHRAE Standard 52.2—2012, Method of Testing General Ventilation Air-Cleaning Devices for Removal Efficiency by Particle Size (Year: 2014).*
Galka, "Greenhouse Gas Emissions for Refrigerant Choices in Room Air Conditioner Units" (Year: 2012).*

* cited by examiner

*Primary Examiner* — Schyler S Sanks
(74) *Attorney, Agent, or Firm* — Dority & Manning, P.A.

(57) ABSTRACT

A gas sensing system for an air conditioner unit is provided. The air conditioner unit includes a bulkhead that divides a cabinet into an indoor portion and an outdoor portion, and a compressor circulates refrigerant through a sealed system. An electrically protected housing is positioned within the indoor portion and defines a sensor enclosure for receiving a gas sensor for measuring a gas concentration of leaked refrigerant within the sensor enclosure. The housing includes vent apertures to permit leaked refrigerant to enter the sensor enclosure while the vent apertures are covered by filters to prevent contaminants from entering the sensor enclosure.

20 Claims, 4 Drawing Sheets

GAS SENSING SYSTEM FOR AN AIR CONDITIONER UNIT

FIELD OF THE INVENTION

The present disclosure relates generally to air conditioner units, and more particularly to systems and methods for detecting refrigerant leaks in an air conditioner unit.

BACKGROUND OF THE INVENTION

Air conditioner or conditioning units are conventionally utilized to adjust the temperature indoors—i.e. within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces. Another type of air conditioner unit, referred to as a packaged terminal air conditioner unit, operate like split heat pump systems, except that the indoor and outdoor portions are defined by a bulkhead and all system components are housed within a single package.

Conventional air conditioner units include systems for detecting refrigerant leaks, e.g., in order to avoid safety or environmental hazards. For example, many air conditioners use non-dispersive infrared (NDIR) gas sensors, which are particularly susceptible to contamination and fouling by dust, debris, pollen, dander, and other contaminants. These contaminants can shorten the life of the sensor and affect measurement accuracy. Providing a protective cover over the gas sensors may help with contamination but may negatively affect gas flow or diffusion toward the gas sensor, also resulting in inaccurate readings.

Accordingly, improved gas sensing systems for air conditioner units would be useful. More specifically, a gas sensing system that is resistant to contamination and provides accurate gas concentration measurements in an air conditioner unit would be particularly beneficial.

BRIEF DESCRIPTION OF THE INVENTION

Aspects and advantages of the invention will be set forth in part in the following description, or may be apparent from the description, or may be learned through practice of the invention.

In accordance with one exemplary embodiment of the present disclosure, an air conditioner unit defining a vertical, a lateral, and a transverse direction is provided. The air conditioner unit includes a cabinet, a bulkhead positioned within the cabinet and defining an indoor portion and an outdoor portion, a refrigeration loop comprising an outdoor heat exchanger positioned within the outdoor portion and an indoor heat exchanger positioned within the indoor portion, and a compressor operably coupled to the refrigeration loop and being configured for urging a flow of refrigerant through the outdoor heat exchanger and the indoor heat exchanger. A housing is positioned within the indoor portion and defines a sensor enclosure, the housing including a plurality of vent apertures to allow leaked refrigerant to pass into the sensor enclosure. A gas sensor is positioned within the sensor enclosure for measuring a gas concentration of the leaked refrigerant within the sensor enclosure.

In accordance with another exemplary embodiment of the present disclosure, a gas sensing system for an air conditioner unit is provided. The air conditioner unit includes a bulkhead positioned within a cabinet and defining an indoor portion and an outdoor portion, and a sealed system including a compressor for circulating refrigerant The gas sensing system includes a housing positioned within the indoor portion and defining a sensor enclosure, the housing includes a plurality of vent apertures to allow leaked refrigerant to pass into the sensor enclosure, and a gas sensor positioned within the sensor enclosure for measuring a gas concentration of the leaked refrigerant within the sensor enclosure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
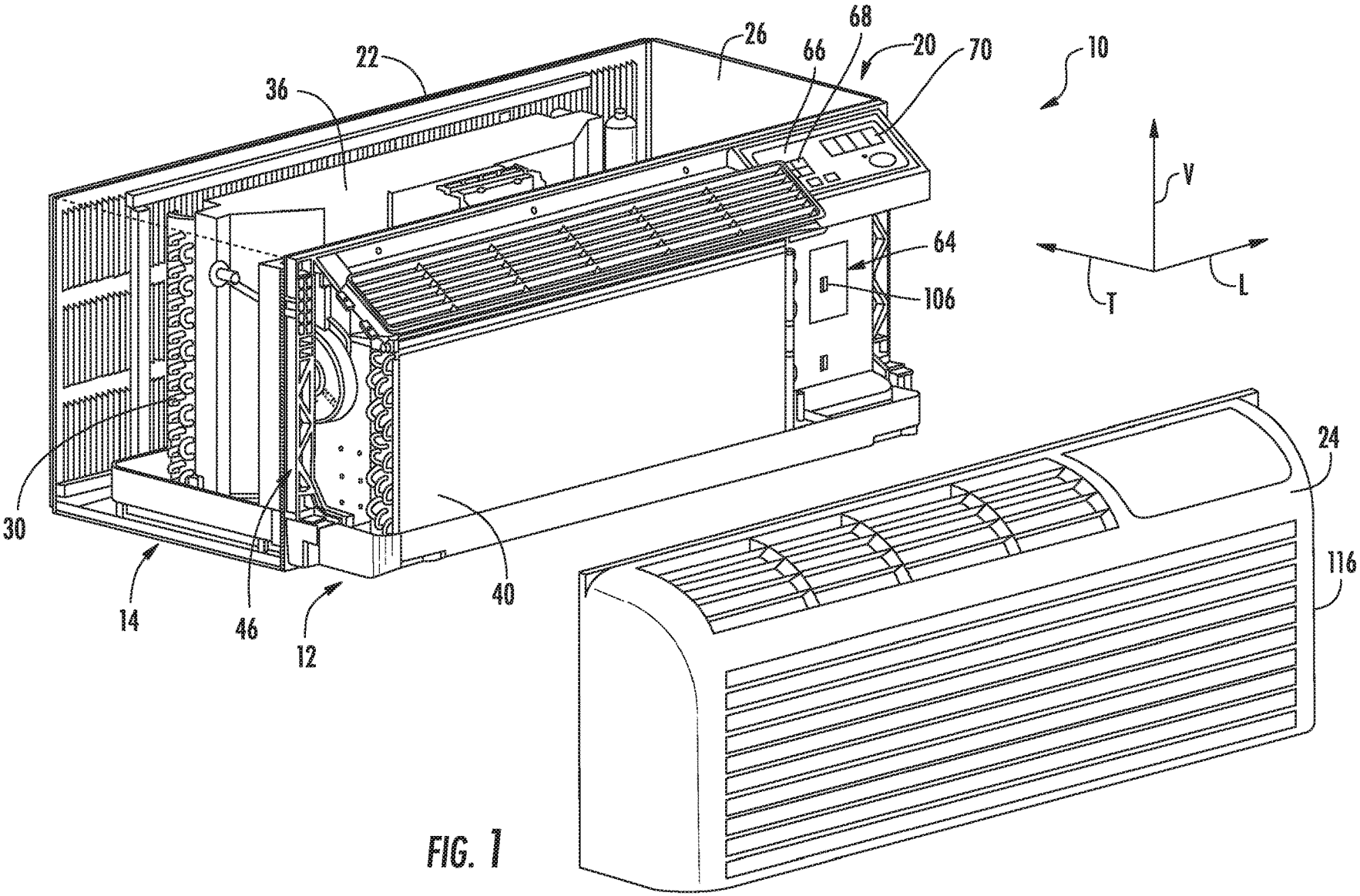
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows. In addition, terms of approximation, such as "approximately," "substantially," or "about," refer to being within a ten percent margin of error.

Referring now to FIG. 1, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A cabinet or housing 20 of the unit 10 may contain various other components of the unit 10. Housing 20 may include, for example, a rear grill 22 and a front grill 24 which may be spaced apart along the transverse direction T by a wall sleeve 26. The rear grill 22 may be part of the outdoor portion 14, and the front grill 24 may be part of the indoor portion 12. Components of the outdoor portion 14, such as an outdoor heat exchanger 30, an outdoor fan 32 (FIG. 2), and a compressor 34 (FIG. 2) may be housed within the wall sleeve 26. A casing 36 may additionally enclose outdoor fan 32, as shown, such that a flow of outdoor air 38 is drawn in through rear grill 22 and passes around casing 36 before being urged by outdoor fan 32 through outdoor heat exchanger 30 and back into the ambient environment.

Figure 2:
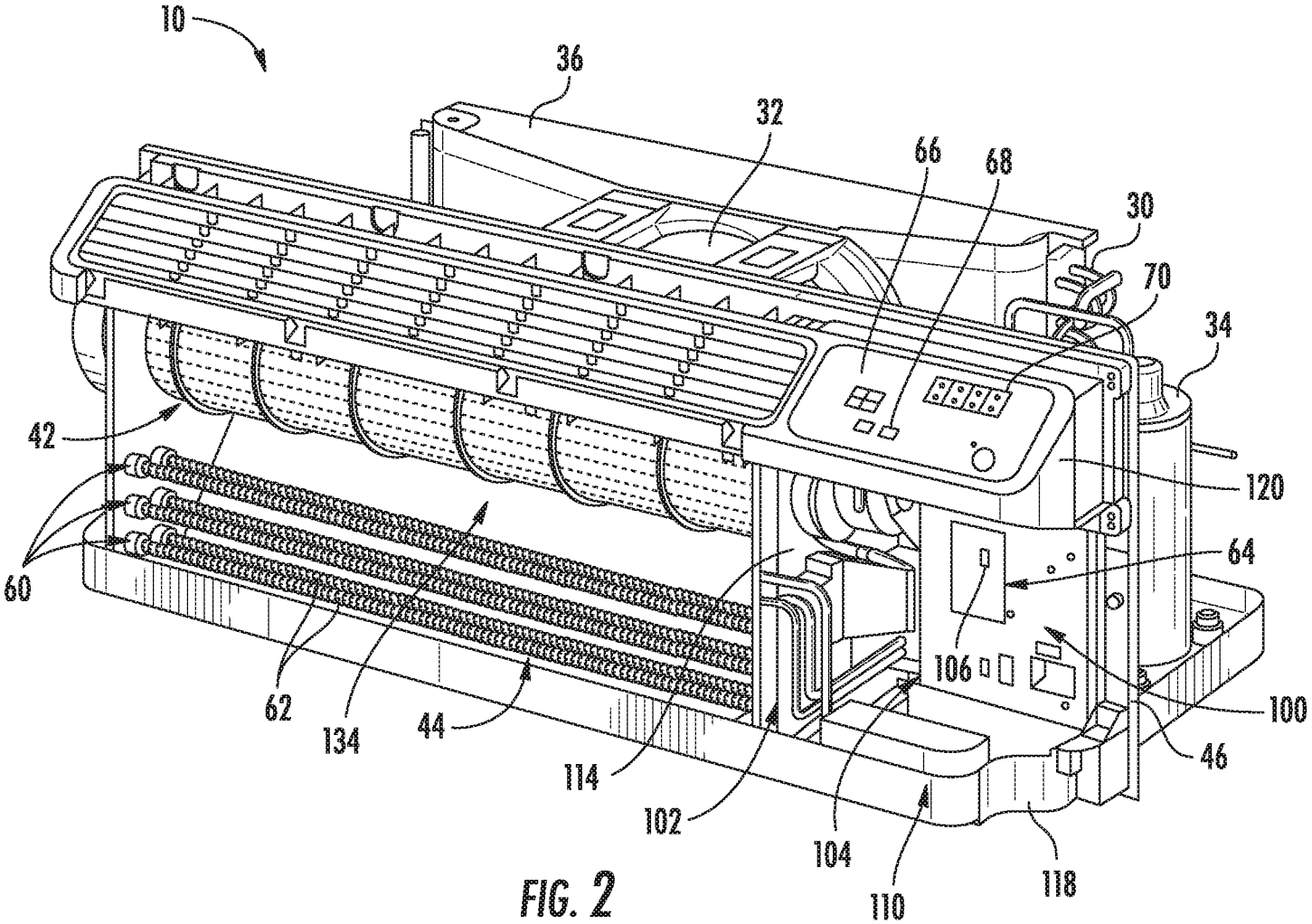
FIG. 2 is another perspective view of components of the indoor portion of the exemplary air conditioner unit of FIG. 1.

Referring now also to FIG. 2, indoor portion 12 may include, for example, an indoor heat exchanger 40 (FIG. 1), a blower fan 42, and a heating unit 44. These components may, for example, be housed behind the front grill 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Figure 3:
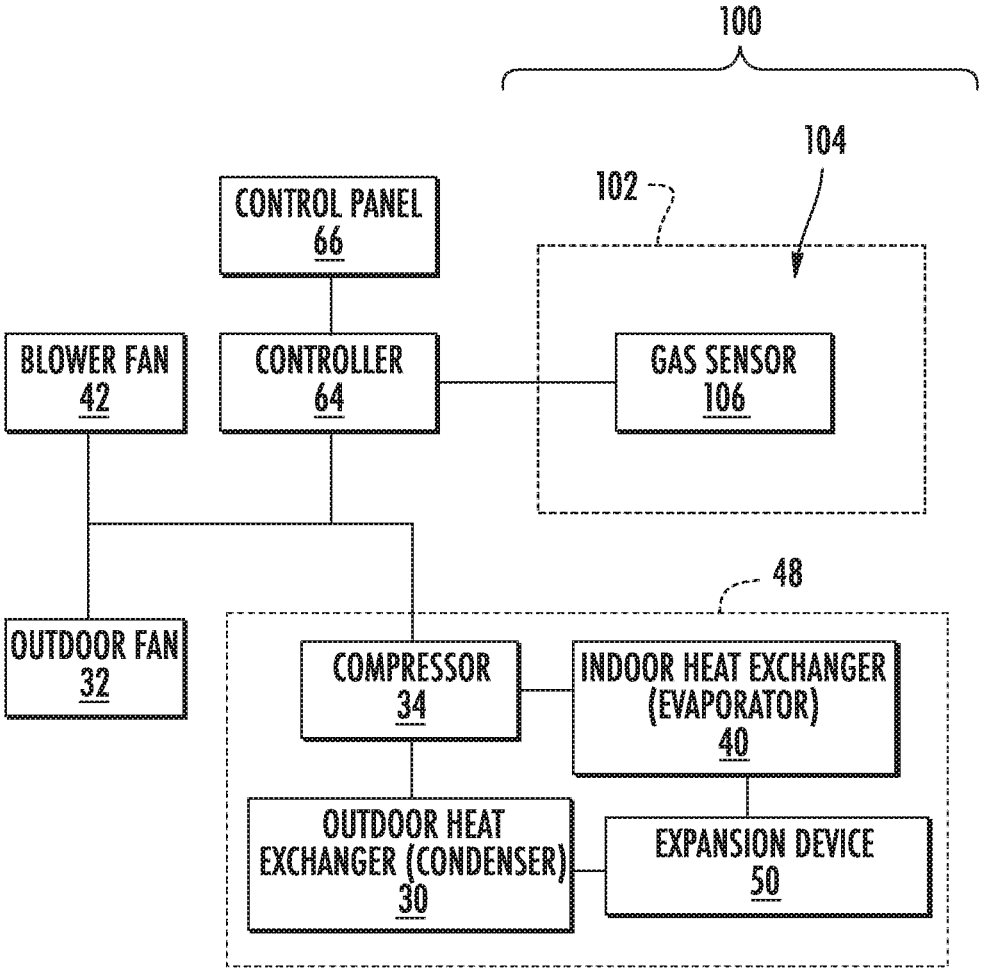
FIG. 3 is a schematic view of a refrigeration loop in accordance with one embodiment of the present disclosure.

Outdoor and indoor heat exchangers 30, 40 may be components of a sealed system or refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between.

Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, R-22, or R-32. According to still other embodiments, it should be understood that the present disclosure is not limited to such examples and rather that any suitable refrigerant may be utilized.

As is understood in the art, refrigeration loop 48 may be alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment of the present subject matter, compressor 34 is a single speed compressor configured for operating at a desirable rated operating speed. However, it should be appreciated that according to alternative embodiments, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be a capillary tube or another suitable expansion device configured for use in a thermodynamic cycle. However, according to alternative embodiments, expansion device may be an electronic expansion valve that enables controlled expansion of refrigerant, as is known in the art. In this regard, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34.

According to the illustrated exemplary embodiment, outdoor fan 32 is an axial fan and indoor blower fan 42 is a centrifugal fan. However, it should be appreciated that according to alternative embodiments, outdoor fan 32 and blower fan 42 may be any suitable fan type. In addition, according to an exemplary embodiment, outdoor fan 32 and blower fan 42 are variable speed fans. For example, outdoor fan 32 and blower fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed.

According to the illustrated embodiment, blower fan 42 may operate as an evaporator fan in refrigeration loop 48 to encourage the flow of air through indoor heat exchanger 40. Accordingly, blower fan 42 may be positioned downstream of indoor heat exchanger 40 along the flow direction of indoor air and downstream of heating unit 44. Alternatively, blower fan 42 may be positioned upstream of indoor heat exchanger 40 along the flow direction of indoor air and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) blower fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. Controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66, and may be in communication with the controller 64. Display 70 may, for example be a touchscreen or other text-readable display screen, or alternatively may simply be a light that can be activated and deactivated as required to provide an indication of, for example, an event or setting for the unit 10.

Referring now generally to FIGS. 1 through 4, a gas sensing system 100 will be described according to exemplary embodiments of the present subject matter. In general, gas sensing system 100 includes a housing 102 that defines a sensor enclosure 104. Gas sensing system 100 further includes a gas sensor 106 that is positioned in sensor enclosure 104. In general, gas sensor 106 is configured for monitoring gas levels, e.g., to determine whether refrigerant (e.g. identified herein generally by reference numeral 108) is leaking from sealed system or refrigeration loop 48. Although gas sensor 106 is described herein as being configured for detecting leaked refrigerant 108, it should be appreciated that aspects of the present subject matter may be applied to the detection of other gases as well.

However, as noted above, gas sensor 106 may be sensitive to contaminants or debris buildup, thus resulting in accurate measurements and/or premature wear or failure of the gas sensor 106. Therefore, sensor enclosure 104 may generally be a clean zone into which gas fumes may diffuse or propagate, but which is at least partially protected from debris, dust, pollen, dander, and other contaminants. Although an exemplary description of housing 102, gas sensor 106, and the operation gas sensing system 100 will be described below, it should be appreciated that variations and modifications may be made while remaining scope of the present subject matter.

According to the illustrated embodiment, housing 102 and sensor enclosure 104 are positioned within indoor portion 12 of air conditioner unit 10. In this regard, it may be desirable to position housing 102 within indoor portion 12 (e.g., on the room side relative to bulkhead 46) due to the inherent cleanliness of indoor portion 12, particularly relative to outdoor portion 14 which is commonly much more exposed to outside contaminants. Notably, refrigerant leaks 108 may be increasingly common in outdoor heat exchanger 30, which is commonly the higher-pressure end of refrigeration loop 48. Therefore, gas sensing system 100 and housing 102 may include features for improving detection of outdoor leaks, as described in more detail below. Furthermore, although gas sensing system 100 is described herein as having a single gas sensor 106 positioned within indoor portion 12, it should be appreciated that according to alternative embodiments, sensor enclosure 104 and gas sensor 106 may be positioned at any other suitable location, e.g., within outdoor portion 14. According to still other embodiments, gas sensing system 100 may include multiple gas sensors 106, e.g., such that some are positioned within indoor portion 12 and some are positioned within outdoor portion 14.

In general, housing 102 may be formed from any suitable material and may have any suitable shape, number of walls, geometry, configuration, etc. For example, according to an exemplary embodiment, housing 102 may be formed from a plurality of walls 110, each of which may be formed from an electrically insulating material, such as plastic or polycarbonate. In this manner, housing 102 and sensor enclosure 104 may be electrically protected, such that hazardous situations may be mitigated or avoided. In this regard, housing 102 may reduce the risk of sparks or ignition sources that might ignite leaking refrigerant 108 in the event the gas leak.

Figure 4:
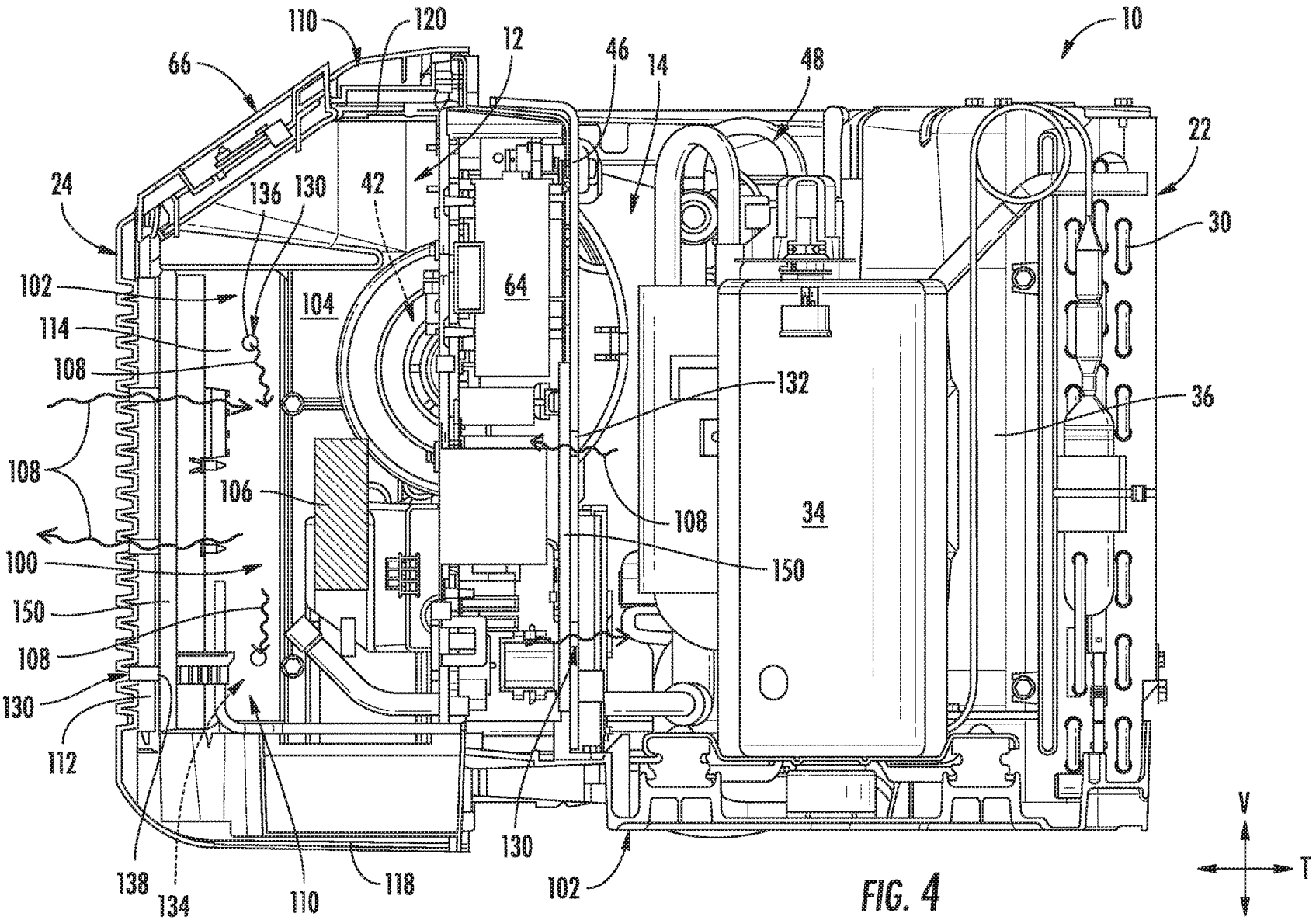
FIG. 4 is a cross sectional view of the exemplary air conditioner unit of FIG. 1 and a gas sensing system according to an exemplary embodiment of the present subject matter.

According to the illustrated embodiment shown in FIG. 4, housing 102 is formed from or defined by various walls 110 within the air conditioner unit 10. Specifically, sensor enclosure 104 may be defined or bounded along the transverse direction T by a front wall 112 and bulkhead 46. In addition, sensor enclosure 104 may be defined or bounded along the lateral direction L by an end wall 114 and a sidewall 116 (see FIG. 1) of front grill 24. Along the vertical direction V, sensor enclosure 104 may be defined by a bottom wall 118 and a top wall 120 of front grill 24. In this regard, each of bulkhead 46, front wall 112, end wall 114, sidewall 116, bottom wall 118, and a top wall 120 may be substantially solid walls that define housing 102 and are joined to form a substantially enclosed space, e.g., sensor enclosure 104.

Although housing 102 is defined above as being formed from a plurality of joined walls 110, it should be appreciated that according to alternative embodiments, housing 102 may be a self-contained box or container that is positioned within indoor portion 12. In addition, the various walls 110 may have different sizes and shapes, may be formed from different or similar materials, and may include any other suitable features for improving gas flow and/or detection. Thus, the construction of housing 102 described herein is only exemplary and is not intended to limit the scope of the present subject matter in any manner Notably, a fully enclosed and gas tight sensor enclosure 104 may prevent the flow of leaked refrigerant 108 from reaching gas sensor 106. Therefore, according to exemplary embodiments the present subject matter, housing 102 defines a plurality of vent apertures (e.g., identified generally by reference numeral 130) to allow leaked refrigerant 108 pass into sensor enclosure 104. In this regard, for example, vent apertures 130 may be most desirable for providing fluid communication with regions of air conditioner 10 that are most likely to generate refrigerant leaks 108.

Thus, for example, if sensor enclosure 104 is defined by bulkhead 46, the plurality of apertures 130 may include bulkhead apertures 132 that are defined through the bulkhead 46 to provide fluid communication between outdoor portion 14 (e.g. the region containing outdoor heat exchanger 30) and sensor enclosure 104. In addition, continuing the example from above, housing 102 may be defined in part by end wall 114, which may form a boundary of a heat exchanger housing 134 that contains indoor heat exchanger 40. Thus, the plurality of vent apertures 130 may include indoor apertures 136 that are defined through end wall 114 to provide fluid communication between heat exchanger housing 134 and sensor enclosure 104. In addition, front apertures 138 may be defined through front wall 112. In this regard, bulkhead apertures 132 may allow leaked refrigerant 108 from outdoor heat exchanger 30 to flow into sensor enclosure 104, indoor apertures 136 may allow leaked refrigerant 108 from indoor heat exchanger 40 to flow into sensor enclosure 104, and front apertures 138 may allow leaked refrigerant 108 to flow into sensor enclosure 104 from the room, as shown generally in FIG. 4.

It should be appreciated that according to alternative embodiments, housing 102 may define any other suitable number and size of apertures in any other suitable walls 110. In this regard, the number, size, and position of vent apertures 130 may vary depending on the particular application and various practical considerations. For example, if a wall 110 includes a small aperture 130 for providing fluid communication between sensor enclosure 104 and a certain enclosed space, it may be desirable to provide a second aperture in the same wall 130, e.g., to define both an inlet and an outlet to facilitate gas circulation. Thus, according to exemplary embodiments, at least some of the plurality of walls 110 may define at least two vent apertures 130.

In addition, it may be desirable to limit the size of such apertures, e.g., in order to reduce the flow of unconditioned air into indoor portion 12. In this regard, for example, the total cross-sectional flow area of apertures 130 defined in any given wall 110 may be restricted to a particular size. For example, bulkhead apertures 132 may define a total flow area. According to exemplary embodiments, the total flow area may be greater than about 0.1 square inches, greater than about 0.2 square inches, greater than about 0.5 square inches, greater than about 0.8 square inches, or about 1 square inch. In addition, or alternatively, the total flow area may be less than about 5 square inches, less than about 3 square inches, less than about 2 square inches, less than about 1 square inch, or less.

Notably, defining vent apertures 130 within housing 102 may provide path for dirt, debris, and other contaminants to enter sensor enclosure 104. Therefore, according to exemplary embodiments the present subject matter, gas sensing system 100 may further include one or more filters 150 that are positioned over or otherwise cover vent apertures 130. In this regard, for example, gas sensing system 100 may include a single filter 150 that is draped over or wrapped around the entire housing 102. Alternatively, gas sensing system 100 may include a plurality of filters, with one or more filters 150 being positioned over some or all of the apertures 130.

Notably, high-performance filters may not be needed or desired, e.g., to reduce flow restriction, costs, etc. According to exemplary embodiments, each filter 150 may have a Minimum Efficiency Reporting Value (MERV) rating of at least 1, at least 2, at least 3, at least 4, or greater. In addition, it should be appreciated that the filter ratings may vary depending on where the filter 150 is located. For example, filters positioned over bulkhead apertures 132 may have a higher MERV rating than filters positioned over indoor apertures 136 or front apertures 138. Indeed, certain vent apertures 130 may have no filter 150 positioned over them at all. Other types, positions, and configurations of filters 150 are possible and within the scope of the present subject matter.

As explained above, air conditioner unit 10 may include a controller 64 for regulating the operation of air conditioner unit 10. Notably, controller 64 may be coupled to gas sensing system 100, or more particularly gas sensor 106, e.g., for regulating operation of air conditioner unit 10 in response to detected gas levels. According to an exemplary embodiment, controller 64 is also positioned within sensor enclosure 104, e.g., to provide a substantially contaminant free environment and extend the life of controller 64. In this regard, gas sensor 106 may be mounted directly to controller 64 or may be otherwise communicatively coupled to controller 64.

In general, controller 64 may be configured for measuring the gas concentration of leaked refrigerant 108 within sensor enclosure 104 using gas sensor 106. In addition, controller 64 may be programmed for determining that a gas leak has occurred when the gas concentration exceeds a predetermined concentration threshold, such as about 1%, 2%, 4%, 5%, or another suitable threshold measure in gas concentration per volume. According to exemplary embodiments, in order to avoid nuisance trips in the event of intermittent spikes in gas concentration, controller 64 may be programmed for taking an average gas concentration over a predetermined time period (such as 60 seconds or several minutes) and only determining that a gas leak has occurred when the average concentration over that predetermined time period exceeds the predetermined concentration threshold.

In the event a gas leak is detected, controller 64 may be further configured for implementing corrective action. For example, according to exemplary embodiments, the implementation of corrective action may include adjusting at least one operating parameter of the air conditioner unit in response to detecting a gas leak. As used herein, an "operating parameter" of air conditioner unit 10 is any cycle setting, operating time, compressor speed, fan speed, part configuration, or other operating characteristic that may affect the performance of air conditioner unit 10. Thus, references to operating parameter adjustments or "adjusting at least one operating parameter" are intended to refer to control actions intended to affect system performance based on the gas leak condition. For example, adjusting an operating parameter may include shutting down the sealed system, e.g., by turning off compressor 34, providing a user notification, scheduling a maintenance technician, etc. Other operating parameter adjustments are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical, a lateral, and a transverse direction, the air conditioner unit comprising:

a cabinet;

a bulkhead positioned within the cabinet and defining an indoor portion and an outdoor portion;

a refrigeration loop comprising an outdoor heat exchanger positioned within the outdoor portion and an indoor heat exchanger positioned within the indoor portion;

a compressor operably coupled to the refrigeration loop and being configured for urging a flow of refrigerant through the outdoor heat exchanger and the indoor heat exchanger;

a housing positioned within the indoor portion and defining a sensor enclosure, the housing comprising a plurality of vent apertures to allow leaked refrigerant to pass into the sensor enclosure, wherein the sensor enclosure is defined at least in part by the bulkhead, and wherein the plurality of vent apertures comprise bulkhead apertures defined through the bulkhead to provide fluid communication between the outdoor portion and the sensor enclosure; and a gas sensor positioned within the sensor enclosure for measuring a gas concentration of the leaked refrigerant within the sensor enclosure.

2. The air conditioner appliance of claim 1, wherein the bulkhead apertures define a total flow area, and wherein the total flow area is between about 0.5 and 1.5 square inches.

3. The air conditioner of claim 2, wherein the total flow area is about 1 square inch.

4. The air conditioner unit of claim 1, wherein the sensor enclosure is defined at least in part by an end wall that defines a heat exchanger housing for containing the indoor heat exchanger, wherein the plurality of vent apertures comprise indoor apertures defined through the end wall to provide fluid communication between the heat exchanger housing and the sensor enclosure.

5. The air conditioner unit of claim 1, wherein the housing comprises a plurality of walls, and wherein at least one of the plurality of walls comprises two of the plurality of vent apertures.

6. The air conditioner unit of claim 1, further comprising:

a plurality of filters, wherein each of the plurality of vent apertures is covered by at least one of the plurality of filters.

7. The air conditioner unit of claim 6, wherein each of the plurality of filters has a Minimum Efficiency Reporting Value (MERV) rating of at least 4.

8. The air conditioner unit of claim 1, further comprising a controller operably coupled to the compressor and the gas sensor, wherein the controller is configured for:

measuring the gas concentration of the leaked refrigerant within the sensor enclosure using the gas sensor;

determining that a gas leak has occurred when the gas concentration exceeds a predetermined threshold; and implementing corrective action when the gas leak is detected.

9. The air conditioner unit of claim 8, wherein implementing corrective action comprises stopping operation of the compressor.

10. The air conditioner unit of claim 8, wherein determining that the gas leak has occurred comprises:

obtaining an average gas concentration percentage over a predetermined test period; and determining that the average gas concentration percentage exceeds a predetermined threshold.

11. The air conditioner unit of claim 8, wherein the controller is positioned within the sensor enclosure.

12. The air conditioner unit of claim 1, wherein the refrigerant is R-32 gas.

13. The air conditioner unit of claim 1, wherein the housing is formed from an electrically insulating material.

14. A gas sensing system for an air conditioner unit, the air conditioner unit comprising a bulkhead positioned within a cabinet and defining an indoor portion and an outdoor portion, and a sealed system comprising a compressor for circulating refrigerant, the gas sensing system comprising:

a housing positioned within the indoor portion and defining a sensor enclosure, the housing comprising a plurality of vent apertures to allow leaked refrigerant to pass into the sensor enclosure, wherein the sensor enclosure is defined at least in part by the bulkhead, and wherein the plurality of vent apertures comprise bulkhead apertures defined through the bulkhead to provide fluid communication between the outdoor portion and the sensor enclosure; and a gas sensor positioned within the sensor enclosure for measuring a gas concentration of the leaked refrigerant within the sensor enclosure.

15. The gas sensing system of claim 14, wherein the sensor enclosure is defined at least in part by an end wall that defines a heat exchanger housing for containing the indoor heat exchanger, wherein the plurality of vent apertures comprise indoor apertures defined through the end wall to provide fluid communication between the heat exchanger housing and the sensor enclosure.

16. The gas sensing system of claim 14, further comprising:

a plurality of filters, wherein each of the plurality of vent apertures is covered by at least one of the plurality of filters.

17. The gas sensing system of claim 14, further comprising a controller operably coupled to the sealed system, wherein the controller is configured for:

measuring the gas concentration of the leaked refrigerant within the sensor enclosure using the gas sensor;

determining that a gas leak has occurred when the gas concentration exceeds a predetermined threshold; and implementing corrective action when the gas leak is detected.

18. The gas sensing system of claim 17, wherein implementing corrective action comprises stopping operation of the compressor.

19. An air conditioner unit defining a vertical, a lateral, and a transverse direction, the air conditioner unit comprising:

a cabinet;

a bulkhead positioned within the cabinet and defining an indoor portion and an outdoor portion;

a refrigeration loop comprising an outdoor heat exchanger positioned within the outdoor portion and an indoor heat exchanger positioned within the indoor portion;

a compressor operably coupled to the refrigeration loop and being configured for urging a flow of refrigerant through the outdoor heat exchanger and the indoor heat exchanger;

a housing positioned within the indoor portion and defining a sensor enclosure, the housing comprising a plurality of vent apertures to allow leaked refrigerant to pass into the sensor enclosure, wherein the sensor enclosure is defined at least in part by an end wall that defines a heat exchanger housing for containing the indoor heat exchanger, wherein the plurality of vent apertures comprise indoor apertures defined through the end wall to provide fluid communication between the heat exchanger housing and the sensor enclosure; and a gas sensor positioned within the sensor enclosure for measuring a gas concentration of the leaked refrigerant within the sensor enclosure.

20. The air conditioner unit of claim 19, wherein the sensor enclosure is defined at least in part by the bulkhead, and wherein the plurality of vent apertures comprise bulkhead apertures defined through the bulkhead to provide fluid communication between the outdoor portion and the sensor enclosure.

* * * * *